US009339360B2

(12) United States Patent
Uchiyama et al.

(10) Patent No.: US 9,339,360 B2
(45) Date of Patent: May 17, 2016

(54) ARTIFICIAL INSEMINATION STRAW

(75) Inventors: Kyoko Uchiyama, Maebashi (JP); Yoshiaki Minato, Maebashi (JP)

(73) Assignee: Livestock Improvement Association of Japan, Inc. (JP)

( * ) Notice: Subject to any disclaimer, the term of this patent is extended or adjusted under 35 U.S.C. 154(b) by 121 days.

(21) Appl. No.: 13/990,987

(22) PCT Filed: Dec. 1, 2011

(86) PCT No.: PCT/JP2011/077813
§ 371 (c)(1),
(2), (4) Date: Jun. 20, 2013

(87) PCT Pub. No.: WO2012/074060
PCT Pub. Date: Jun. 7, 2012

(65) Prior Publication Data

US 2013/0267771 A1 Oct. 10, 2013

(30) Foreign Application Priority Data

Dec. 1, 2010 (JP) ..... 2010-268423

(51) Int. Cl.
*A61D 19/02* (2006.01)

(52) U.S. Cl.
CPC ..... *A61D 19/024* (2013.01)

(58) Field of Classification Search
CPC ..... A61D 19/02; A61D 19/024; A61D 19/00
USPC ..... 600/35
See application file for complete search history.

(56) References Cited

U.S. PATENT DOCUMENTS

| | | | | |
|---|---|---|---|---|
| 3,973,003 | A * | 8/1976 | Colas | A61D 19/00 424/561 |
| 2003/0008918 | A1* | 1/2003 | Kurogi et al. | 514/553 |
| 2011/0004052 | A1* | 1/2011 | Schenk | 600/35 |

FOREIGN PATENT DOCUMENTS

| | | | |
|---|---|---|---|
| JP | A-2008-259506 | A | 10/2008 |
| JP | A-2009-22214 | A | 2/2009 |
| JP | A-2009-142237 | A | 7/2009 |
| WO | WO 03/096926 | A1 | 11/2003 |

OTHER PUBLICATIONS

Gil et al. "Influence of centrifugation and different extenders on post-thaw sperm quality of ram semen," *Theriogenology*, 54(1):93-108 (2000).

International Search Report for International Patent Application No. PCT/JP2011/077813 (mailed Feb. 21, 2012).

Livestock Improvement Association of Japan Inc. !!Sort$^{90}$ Straw ga Atarashiki Narimashita!! retrieved Feb. 13, 2012, http://liaj.or.jp/giken/gijutsubu/hanbetu/pdf/2sou_sutoro-pdf (English Translation).

Katoh et al. "Results of superovulatory response in Japanese Black Cattle by sexed semen." *Eastern Japanese Embryo Transfer Society*. 25:60-61 (2009). (English Translation only).

* cited by examiner

*Primary Examiner* — Samuel Gilbert
(74) *Attorney, Agent, or Firm* — Merchant & Gould P.C.

(57) ABSTRACT

The invention relates to a straw for cryopreservation that improves the chance of conception of semen after cryopreservation. The straw is produced by introducing a partitioning layer into a straw for artificial insemination to separate layers, thereby forming a semen storage layer containing an aqueous solution containing semen and an anti-freeze agent on one side and a dilution layer containing no anti-freeze agent on the other side, wherein a dilution solution containing an aqueous solution containing tris(hydroxymethyl aminomethane), citric acid, glucose and sodium chloride is used in the dilution layer.

9 Claims, 8 Drawing Sheets

ARTIFICIAL INSEMINATION STRAW

This application is a U.S. National Stage Application under 35 U.S.C. §371 of International Patent Application No. PCT/JP2011/077813 filed 1 Dec. 2011, which claims the benefit of priority to Japanese Patent Application No. 2010-268423 filed 1 Dec. 2010 in Japan, the disclosures of all of which are hereby incorporated by reference in their entireties. The International Application was published in Japanese on 7 Jun. 2012 as WO 2012/074060.

TECHNICAL FIELD

The present invention relates to an artificial insemination straw for used in artificial insemination, comprising a dilution layer, a partitioning layer, and a semen preserving layer.

BACKGROUND ART

In cattle reproduction, prevalence of artificial insemination in Japan is nearly 100%. However, the conception rate of cattle is decreasing yearly: the first service conception rate of 62.4% and the 1st-3rd service conception rate of 62% in 1989 declined to the first service conception rate of 46.1% and the 1st-3rd service conception rate of 44.6% in 2008. While there are many possible factors contributing to the reduction in the conception rate, one possible factor is considered to be stress, etc., due to the enhanced milk production of cows.

When conception fails, it is necessary to carry out artificial insemination again on the non-gravid female cattle, which imposes a burden on breeding farmers in terms of cost and labor. Thus, there is a need for the enhanced conception rate not only from the viewpoint of female cattle, but from the viewpoint of a bull.

For artificial insemination of livestock, frozen semen aliquoted in a semen straw is usually used. A semen straw for cryopreservation can be prepared by diluting semen in a primary diluent for cryopreservation and then diluting it in a secondary diluent, which is a cryoprotectant-added primary diluent, and filling the liquid in straws, and the semen straw is then freeze-preserved in liquid nitrogen (Non-patent document 1). Conventionally, monolayer straws comprising a single semen preserving layer alone were used, but in recent years, a semen filling device capable of filling two layers was developed (Patent Document 1). This semen filling device can arrange the same cryopreservation solution as that for the semen preserving layer at the cotton plug side, in order to prevent the loss of semen due to contact of the semen preserving layer with the cotton plug.

For semen diluting liquids to be used in freezing semen, ingredients thereof are being improved for the purpose of improving the survival rate and fertilization ability of spermatozoa after freezing and thawing. As the diluent, an egg yolk-based preserving solution comprising egg yolk, saccharides, and a buffer as main ingredients, and a milk-based preserving solution comprising milk as the main ingredients are generally known, and the egg yolk-based preserving solution is widely used on a global basis. Egg yolk has effects of alleviating cold shock, protecting the cell membrane, maintaining the viability of spermatozoa, etc., and these effects are thought to result from lipoprotein and phospholipid in the egg yolk. In order to prevent freezing damage on spermatozoa, various cryopreservatives (Patent Document 2), spermatozoa-activating agents for enhancing the fertility rate (Patent Document 3) and the like are being investigated. During the freezing and thawing process, generally no salts are added to the diluent for freezing, since salts can have adverse effects on spermatozoa.

CITATION LIST

Patent Literatures

PLT 1: Kohyo (Japanese National Publication) No. 2010-503438

PLT 2: Kokai (Japanese Unexamined Patent Publication) No. 2005-270006

PLT 3: Kokai (Japanese Unexamined Patent Publication) No. 2005-213147

Non-Patent Literatures

NPL 1: Textbook for a course for artificial insemination on livestock

NPL 2: Guthrie et al., Biology of Reproduction 67, 1811-1816 (2002)

SUMMARY OF INVENTION

Problem to be Solved by the Invention

The problem to be solved by the invention is to improve conventional straws for artificial insemination thereby to improve the conception rate.

Means to Solve the Problems

As a result of intensive research carried by the inventors on the survival of spermatozoa filled in straws for artificial insemination and on the conception rate in artificial insemination using straws for artificial insemination, the present inventors have found that the conception rate can be surprisingly enhanced when a straw for artificial insemination was prepared by introducing a partitioning layer in an artificial insemination straw to separate layers, and by containing a semen preserving layer comprising an aqueous solution containing semen and a cryoprotectant on one side, and a dilution layer consisting of an aqueous solution containing one or more of a buffer, a saccharide or a salt on the other side, and therefore have attained the present invention.

Thus, the present invention encompasses the following inventions:

[1] A straw for artificial insemination, comprising:

a straw; and a dilution layer comprising an aqueous solution containing one or more of a buffer, a saccharide or a salt, a partitioning layer, and a semen preserving layer consisting of an aqueous solution containing semen and a cryoprotectant wherein the layers are disposed in the cavity of said straw, and the dilution layer and the semen preserving layer are separated by the partitioning layer.

[2] The straw for artificial insemination according to [1], wherein the ratio of said dilution layer and said semen preserving layer is 3:2 to 1:4.

[3] The straw for artificial insemination according to [1] or [2], wherein the ratio of said dilution layer and said semen preserving layer is 3:2 to 1:2.

[4] The straw for artificial insemination according to [3], wherein the ratio of said dilution layer and said semen preserving layer is 1:1.

[5] The straw for artificial insemination according to any one of [1] to [4], wherein the aqueous solution of said dilution layer does not contain glycerol.

[6] The straw for artificial insemination according to any one of [1] to [5], wherein the buffer of said dilution layer is tris(hydroxymethylaminomethane) and citric acid, the saccharide is glucose, and the salt is sodium chloride.

[7] The straw for artificial insemination according to any one of [1] to [6], wherein the osmotic pressure of the aqueous solution of said dilution layer is 230 to 400 mOsm.

[8] The straw for artificial insemination according to any one of [1] to [7], wherein the pH of the aqueous solution of said dilution layer is 6.4 to 7.5.

[9] The straw for artificial insemination according to any one of [1] to [8], wherein the concentration of said glucose is 10 mM to 50 mM and the concentration of said sodium chloride is 50 to 100 mM.

[10] The straw for artificial insemination according to any one of [1] to [9], wherein said dilution layer does not contain egg yolk or a cryoprotectant.

[11] The straw for artificial insemination according to any one of [1] to [10], wherein said tris(hydroxymethylaminomethane) is 140.6 mM, said citric acid is 45.3 mM, said glucose is 16.7 mM, and said sodium chloride is 79.1 mM.

[12] The straw for artificial insemination according to any one of [1] to [11], wherein the volume of said straw is 0.25 to 0.5 ml.

[13] The straw for artificial insemination according to any one of [1] to [12], wherein said semen is the semen of a mammal.

[14] The straw for artificial insemination according to any one of [1] to [13], wherein said semen is the semen of cattle or a dog.

[15] The straw for artificial insemination according to any one of [1] to [14], wherein the aqueous solution of said dilution layer further contains a spermatozoa motility activator.

[16] The straw for artificial insemination according to any one of [1] to [15], wherein said straw for artificial insemination is frozen.

Effects of the Invention

By using a straw for artificial insemination comprising a dilution layer consisting of an aqueous solution containing one or more of a buffer, a saccharide or a salt and a semen preserving layer comprising an aqueous solution containing semen and a cryoprotectant in artificial insemination, said layers being separated by a partitioning layer in the cavity of the straw, the conception rate can be improved as compared to artificial insemination using a conventional monolayer straw for artificial insemination.

layer+a partitioning layer+a semen preserving layer, a TCGN dilution layer+a partitioning layer+a semen preserving layer, or a semen preserving layer (monolayer) in the cavity of the straw. The values are expressed in mean and standard deviation (N=10). It can be seen that the supercooling time is short when a TCGN dilution layer is used as the dilution layer.

Figure 9:
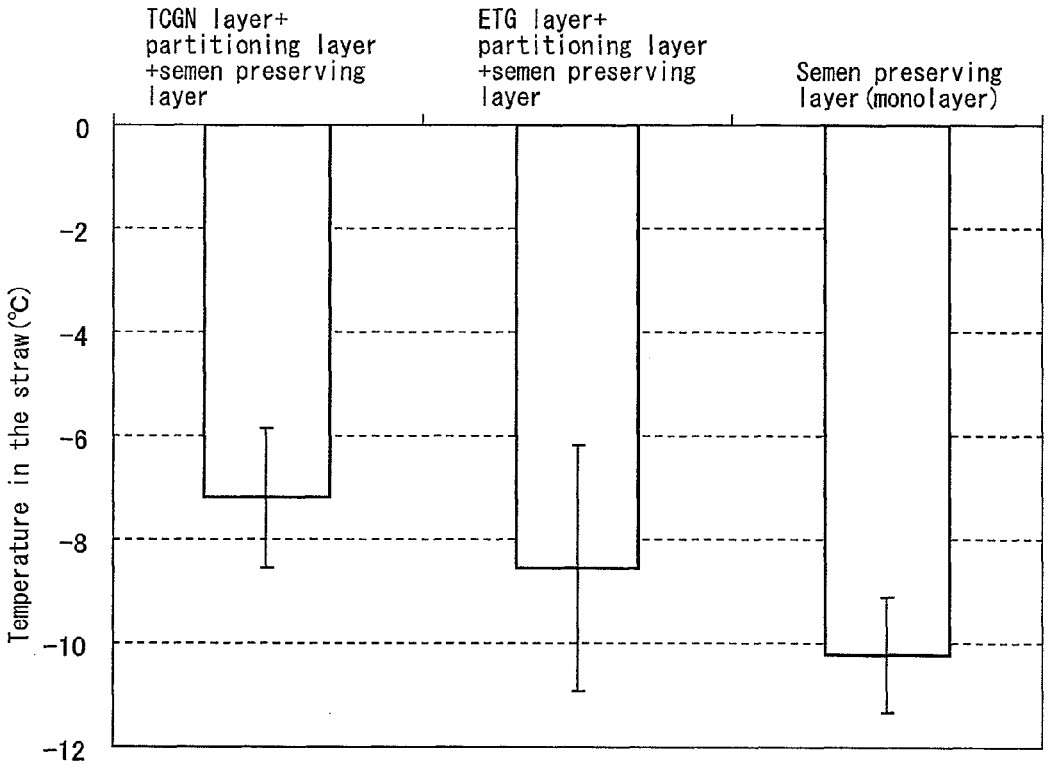

FIG. 9 is a graph showing the temperature at which ice deposited in the semen preserving layer at the time of freezing straws for artificial insemination in liquid nitrogen vapor, said straws comprising glycerol-added egg yolk-tris-saccharide (ETG) layer+a partitioning layer+a semen preserving layer, a TCGN dilution layer+a partitioning layer+a semen preserving layer, or a semen preserving layer (monolayer) in the cavity of the straw. The values are expressed in mean and standard deviation (N=10). It can be seen that ice forms at high temperature when a TCGN dilution layer is used as the dilution layer.

DESCRIPTION OF EMBODIMENTS

The present invention relates to a straw for artificial insemination, comprising (1) a dilution layer consisting of an aqueous solution containing one or more of a buffer, a saccharide or a salt; (2) a partitioning layer; and (3) a semen preserving layer comprising an aqueous solution containing semen and a cryoprotectant, wherein the above layers are disposed in the cavity of the above straw, and the dilution layer and the semen preserving layer are separated by the partitioning layer.

While a straw for use in the straw for artificial insemination of the present invention can be produced with any material, it can be, for example, a cylindrical tube made of plastic such as polyvinyl chloride (PVC) since it is disposable. While straws can be of any length and any diameter, most of commercially available straws are 133 mm long with a diameter of 1.95 mm or 2.85 mm. To a straw in which a cotton plug has been inserted, liquid or gas which is to become a dilution layer, a partitioning layer, and a semen preserving layer is loaded sequentially, and the straw is closed by thermal compression by means of ultrasonication. While the liquid or the gas which will constitute a dilution layer, a partitioning layer, and a semen preserving layer can be manually dispensed, it can also be filled using a filling device described in Patent Document 1. After sealing, it is frozen with a liquid nitrogen vapor for 7-10 minutes, and stored by immersing it in liquid nitrogen.

The volume of a straw for use in the straw for artificial insemination of the present invention can be of any volume, and for example it can be 0.25-5 ml. The volume of the straw can be varied depending on the animal species, and from the viewpoint of freezing the semen of cattle or dogs, 0.25-0.5 ml is preferable. One end of a straw is closed with a plug such as a cotton plug, a dilution layer, a partitioning layer, and a semen preserving layer are sequentially inserted, and then the other end is closed by thermal compression, etc. The dilution layer or the semen preserving layer and the closed end may be in contact with each other, or may be separated by a gas layer. The sequence of the dilution layer and the semen preserving layer can be switched. While a multilayer straw comprising a dilution layer, a partitioning layer, and a semen preserving layer was shown as an embodiment of the present invention, it may be a multilayer straw comprising two or more layers of each of the dilution layer and the semen preserving layer.

In the above dilution layer, preferably the buffer is tris (hydroxymethylaminomethane) and citric acid, the saccharide is glucose, and the salt is sodium chloride. As used herein, such a dilution layer may be termed as a TCGN dilution layer. Preferably, the dilution layer may contain no glycerol.

While the osmotic pressure of the aqueous solution of the dilution layer of the present invention can be of any osmotic pressure as long as it can maintain the fertilization ability of spermatozoa, and it is normally 230-400 mOsm. This range has been specified as a range in which the motility of spermatozoa can be maintained according to the description in Non-Patent Document 2. Preferably, the osmotic pressure of the aqueous solution of the dilution layer may be 260-350 mOsm, and more preferably 280-330 mOsm. The range of 295-320 mOsm is most preferred. While the theoretical value of the osmotic pressure may be calculated from the concentration of the solute, the degree of dissociation etc., it may be determined by using an osmometer. The concentrations of glucose and sodium chloride in the aqueous solution of the dilution layer of the present invention may be determined so that the osmotic pressure of the aqueous solution may be in the above range. The glucose concentration may be 5 mM to 100 mM and preferably 10 mM to 50 mM. The sodium chloride concentration may be 50-200 mM, preferably 50-150 mM, and more preferably 50-100 mM.

The pH of the aqueous solution of the dilution layer of the present invention can be any pH as long as it is in a pH range which is not toxic to spermatozoa, and may be, for example, 6.0-8.0. Preferably it may be 6.4-7.5, and more preferably 6.8-7.2. The concentrations of tris(hydroxymethylaminomethane) and citric acid in the dilution layer of the present invention may be determined so that the final pH of the aqueous solution is in the above pH range. More specifically, the concentration of tris(hydroxymethylaminomethane) of the present invention may be 50-300 mM, and preferably 75-200 mM. The concentration of citric acid may be 20-100 mM, preferably 25-75 mM.

While the dilution layer of the present invention preferably consists of an aqueous solution containing tris(hydroxymethylaminomethane), citric acid, glucose, and sodium chloride, another buffer can be used in stead of tris(hydroxymethylaminomethane) and citric acid as long as it can attain the desired pH. Any buffer having a buffering action at or near neutral pH can be used, and there can be mentioned, for example, Good's buffers such as MES, HEPES, TES, and tricine, phosphate buffer, citrate buffer, acetate buffer, carbonate buffer and the like. Similarly, glucose which is an energy source for spermatozoa, can be replaced with other saccharides or energy sources that spermatozoa can use. Examples other than glucose include xylose, rhamnose, fructose, mannose, galactose, sucrose, lactose, maltose, trehalose, melibiose, raffinose, melezitose, stachyose, dextrin, N-acetyl-D-glucosamine, D-glucronic acid and the like. Also, in stead of sodium chloride, another salt such as potassium chloride, sodium glutamate, potassium glutamate, sodium gluconate, potassium gluconate, sodium citrate, potassium citrate, sodium acetate, potassium acetate, sodium carbonate, potassium carbonate, sodium bicarbonate, potassium bicarbonate and the like may be used.

The aqueous solution of the dilution layer of the present invention can further contain an activating agent that activates spermatozoa. An activating agent include, as a specific example, catechin, caffeine, theophylline, pentoxifylline, procaine, imidazole, sodium pyruvate, hypotaurine, polyphenol, L-glutamine, SOD, vitamin B2, vitamin C, vitamin E, flavonoid, spermine, β-carotene, glutathione, glutathione peroxidase, glutathione reductase, catalase, carnitine, albumin, transferrin, ceruloplasmin, glucose phosphate D-dehydrogenase, and the like. By including an activating agent in the dilution layer separated from the semen preserving layer by a partitioning layer, the activation of spermatozoa can be promoted after thawing when they were injected into the internal uterine orifice or the uterine lumen, without activating spermatozoa before freezing. This makes it possible to activate spermatozoa at suitable timing without wasting the energy of spermatozoa before freezing. Also, the aqueous solution of the dilution layer can contain antibiotics for preservation.

The aqueous solution that contains or does not contain an activating agent for use in the dilution layer of the present invention can be added at the time of artificial insemination separately from the straw for artificial insemination of the present invention. For example, by injecting an aqueous solution that can be used in the dilution layer of the present invention before or after thawing a monolayer-type straw for artificial insemination comprising a semen preserving layer and injecting into the internal uterine orifice or the uterine lumen, the aqueous solution of the dilution layer and the aqueous solution of the semen preserving layer may be mixed in the uterus of female cattle.

The partitioning layer is a layer of any solid, liquid, or gas that prevents the direct contact and mixing of the dilution layer and the semen preserving layer. The partitioning layer includes as an example a gas such as air, inert gas such as nitrogen, and rare gas, a liquid such as an oil (vegetable oil, animal oil) and an organic solvent separable from water, and a solid that can serve as a partition made of any material. The gaseous or liquid partitioning layer may solidify depending on the temperature for cryopreservation. The partitioning layer may be of any length as long as it can separate the dilution layer and the semen preserving layer. In terms of the length and the inner diameter of a straw for artificial insemination, it can be 0.5 cm to 2 cm in length, and the length of 1 cm may generally be used.

As used herein, the length of each layer is the length in the longitudinal direction of a straw. Since the inner diameter of a straw is usually constant, the "length" of each layer is proportional to the volume of each layer.

The semen preserving layer consists of an aqueous solution containing semen and a cryoprotectant. Any cryopreserving solution can be used as long as it is intended for use in cryopreserving semen. As commonly used semen cryopreserving solutions, cryopreserving solutions using egg yolk, milk, soy bean lecithin, etc., are used. Egg yolk-based cryopreserving solutions include an aqueous solution of sodium citrate and the egg yolk of a chicken egg, or an egg yolk-tris-saccharide solution comprising tris(hydroxymethylaminomethane), citric acid, lactose, raffinose, and egg yolk, and are produced by adding antibiotics (such as penicillin and streptomycin), suitable reagents etc. In an egg yolk-tris-saccharide solution, the concentration of tris(hydroxymethylaminomethane) is 75-200 mM, and preferably 100-150 mM, the concentration of citric acid is 25-75 mM, and preferably 30-60 mM, the concentration of lactose is 10-100 mM, and preferably 25-75 mM, the concentration of raffinose is 10-100 mM, and preferably 25-75 mM, and the concentration of egg yolk is 15-25% (Non-Patent Document 1). For example, a glycerol-added egg yolk-tris-saccharide solution in which glycerol was added to an egg yolk-tris-saccharide solution to a concentration of 6.5% is used in sex-sorting semen straws (Sort90) and commercially available frozen semen straws marketed by Livestock Improvement Association of JAPAN, and can be obtained from Sort90. Milk-based frozen preservation solution is an aqueous solution in which a buffer, antibiotics etc., are added to heat-sterilized whole milk or defatted milk. These aqueous solutions need to be changed appropriately depending on the animal species, and cryopreserving solutions suitable for cattle, pigs, goats, horses, and other mammals are known (Non-Patent Document 1).

The cryoprotectant contained in a semen preserving layer is an agent that is substituted for free water in the cell in order to prevent cell contraction and intracellular freezing as well as to prevent denaturation of cellular proteins due to the concentrated salts in the cell. While the cryoprotectant can suppress the amount of ice in the extracellular liquid due to freezing to alleviate physical damage of freezing and thawing processes, the toxic effect of the cryoprotectant may appear depending on the concentration. In order to reduce the toxic effect of the cryoprotectant, fresh semen is diluted with a primary diluent containing no cryoprotectant at the time of preparing a semen diluent, and then diluted with a second diluent containing the cryoprotectant in a step-by-step manner, thereafter the semen is frozen and stored. Generally, a primary diluent and a secondary diluent are only different in the presence or absence of a cryoprotectant. The cryoprotectant for use in the present invention may be any cryoprotectant as long as it is suitable for cryopreserving semen. For example, glycerol, dimethyl sulfoxide (DMSO), ethylene glycol and the like, or mixtures thereof can be used, but in terms of preserving semen, glycerol is preferred.

The volume ratio of the dilution layer to the semen preserving layer in the straw of the present invention may be any ratio. However, from the viewpoint of spermatozoa motility in the mixture after thawing, the ratio of the dilution layer to the semen preserving layer may preferably be in the range of 3:2 to 1:4, more preferably 3:2 to 1:2, and most preferably 1:1.

While the number of spermatozoa contained in the semen preserving layer contained in the straw for artificial insemination of the present invention may be any number as long as it can maintain the fertility, the higher the number of spermatozoa, the higher the conception rate becomes. Since it is believed that by adjusting the sperm concentration as low as possible, the effect exhibited by the construction of the present invention, i.e., the straw for artificial insemination comprising a dilution layer consisting of an aqueous solution containing one or more of a buffer, a saccharide or a salt, a partitioning layer, and a semen preserving layer in the cavity of the straw, can be investigated more clearly, about three million spermatozoa per straw are used in the experiment in the examples below. However, the number of spermatozoa contained in the straw for artificial insemination of the present invention should not be limited to three million, and about one million, about three million, about five million, about seven million, about ten million spermatozoa or more may be contained in a straw. Among them, it may be preferred to contain about more than three million spermatozoa.

The semen contained in the straw for artificial insemination of the present invention may be derived from any animal, as long as artificial insemination can be applied to the animal. Animals to which artificial insemination can be applied include, as an example, any mammals including human, for example domestic animals, pet animals, zoo animals, and experimental animals. Domestic animals include horse, sheep, cattle, pig, goat etc., and pet animals include dog, cat, rabbit etc. The present invention also relates to a straw for artificial insemination containing the semen of animal species of zoo animals such as panda, which are on the verge of extinction.

In another embodiment, the present invention also relates to the method of artificial insemination using a straw for artificial insemination of the present invention. A straw for artificial insemination of the present invention is thawed in a warm bath of 30-40° C., and, after thawing, it is loaded in a plastic injector (such as Cassou gun), which is then injected into the internal uterine orifice or the uterine lumen of female cattle at the last phase of estrus to perform artificial insemination. By using this method of artificial insemination, the conception rate can be enhanced.

This enhancement of the conception rate is thought to result from a variety of reasons, which may include that since an aqueous solution of the semen preserving layer containing a cryoprotectant, after thawing, is diluted with the aqueous solution of the dilution layer containing no cryoprotectant at the time of injection into the internal uterine orifice or the uterine lumen of a domestic animal, the toxic effect of the cryoprotectant can be reduced, the supercooling of the semen preserving layer is prevented by the ice-seeding effect of the dilution layer, glucose as an energy source of spermatozoa is supplied at suitable timing, i.e., at the time of injection into the internal uterine orifice or the uterine lumen, and the like.

EXAMPLES

Example 1

Preparation of a TCGN Diluent, an Egg Yolk-Tris-Saccharide Solution (ET Solution), a Glycerol-Added Egg Yolk-Tris-Saccharide Solution (ETG Solution), and a Sperm Washing Solution 17.031 g of tris(hydroxymethylaminomethane) (Wako Pure Chemical Industries), 9.519 g of citric acid monohydrate (Wako Pure Chemical Industries), 3.000 g of glucose (Wako Pure Chemical Industries), and 4.625 g of sodium chloride (Wako Pure Chemical Industries), 3 ml of penicillium G potassium (1 million IU/4.6 ml SPUF) (Banyu Pharmaceutical), and 3 ml of streptomycin (1000 mg titer/4.3 ml SPUF) (Meiji Seika) were added, and made to 1000 ml with distilled water to obtain an aqueous solution (TCGN diluent) containing 140.6 mM tris(hydroxymethylaminomethane), 45.3 mM citric acid, 16.7 mM glucose and 79.1 mM sodium chloride.

As the egg yolk-tris-saccharide solution (ET), a semen primary diluent used in Sort90 or commercially available frozen semen produced by Livestock Improvement Association of JAPAN was used. The glycerol-added egg yolk-tris-saccharide solution (ETG) is an aqueous solution in which glycerol is added to the egg yolk-tris-saccharide solution (ET) to 6.5%, which can be obtained from Sort90 produced by Livestock Improvement Association of JAPAN, and is identical to the aqueous solution of the semen preserving layer, except that semen is not included.

The sperm washing solution was prepared by dissolving 0.3 g of bovine serum albumin (Wako Pure Chemical Industries) in the TCGN diluent prepared as above and making the volume to 100 ml.

Example 2

Preparation of Straws for Artificial Insemination

According to a conventional method, the spermatozoa concentration of the fresh semen was determined by diluting 10 μl of fresh semen collected from a bull with 400-fold Reagent S which is used with the NucleoCounter SP-100 (Chemometec A/S), and then counting the number of spermatozoa. Depending on the spermatozoa concentration, the fresh semen was diluted with the egg yolk-tris-saccharide solution (ET solution), which is a semen primary diluent, so as to obtain the primary diluted sperm solution with a count of about 40 million of spermatozoa per 1 ml. The primary diluted sperm solution thus obtained was diluted at a volume ratio of 1:1 with a secondary diluent to obtain a glycerol-added egg yolk-tris-saccharide solution (ETG) containing about 20 million spermatozoa per 1 ml.

Figure 1:
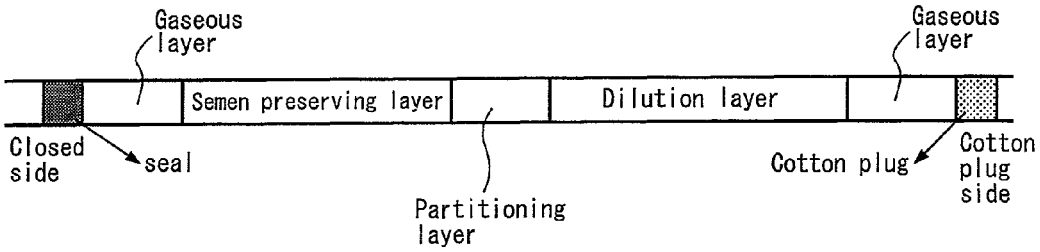
FIG. 1 is a schematic diagram of a straw for artificial insemination comprising a dilution layer+a partitioning layer+a semen preserving layer in the cavity of the straw having a cotton plug therein.

To cotton plug-inserted plastic straws (Fujihira Kogyo, 0.5 ml thin 133 type), 150 μl of the diluent was loaded to make a dilution layer, partitioning it so that the partitioning layer becomes 1 cm, and then 150 μl of the secondary diluted semen is loaded to make a semen preserving layer, followed by heat compression to seal the straws. The schematic diagram of the straw for artificial insemination is shown in FIG. 1. This made the number of spermatozoa per one straw about three million. As the aqueous solution of the dilution layer, the TCGN diluent or a glycerol-added egg yolk-tris-saccharide solution was used. Furthermore, monolayer straws for artificial insemination in which 450 μl of the secondary diluted semen was loaded to cotton plug-inserted straws were prepared. These straws for artificial insemination were exposed to a liquid nitrogen vapor for 7-10 minutes to freeze them, and then immersed in liquid nitrogen and stored.

Example 3

Figure 2:
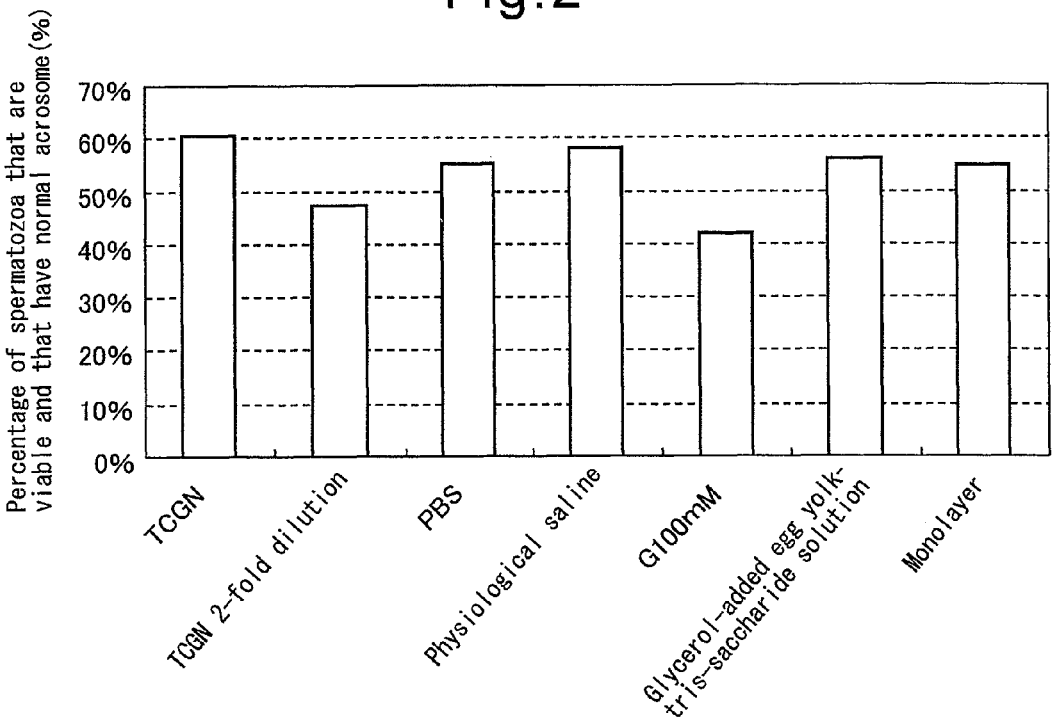
FIG. 2 is a graph showing the percentage of spermatozoa that are viable and have normal acrosome after freezing and thawing straws for artificial insemination obtained by replacing the dilution layer with various aqueous solutions in a straw for artificial insemination having a dilution layer+a partitioning layer+a semen preserving layer in the cavity of the straw. It is shown that the percentage of spermatozoa that are viable and have normal acrosome is the highest when TCGN is used as the dilution layer.

Effect of the Type of the Diluent in the Dilution Layer on the Percentage of Spermatozoa that are Viable and Have Normal Acrosome after Freezing and Thawing As an aqueous solution of the dilution layer, in addition to the TCGN diluent, the effectiveness was tested for the TCGN 2-fold diluent, phosphate buffered saline (PBS), physiological saline, G100 mM (glucose 100 mM), and the glycerol-added egg yolk-tris-saccharide solution. Specifically, straws for artificial insemination comprising a dilution layer containing one of the above diluents, an air partitioning layer, and a semen preserving layer were prepared, and thawed at 38° C. according to a conventional method. The entire contents of the straw were transferred into polystyrene conical tubes. After agitating well, they were washed twice with a sperm washing solution by centrifuging at room temperature, 2000 rpm for 5 minutes. Subsequently, the washed sperm were adjusted to 10 million/ml, 2 μg/ml of PI (Sigma) and 2 μg/ml of PNA-FITC (Sigma) were added, and incubated at 25° C. for 10 minutes. Subsequently, they were washed once with the sperm washing solution by centrifuging at room temperature, 3000 rpm for 5 minutes. Then, the percentage of spermatozoa that were viable and that had normal acrosome was determined for 20,000 spermatozoa per sample by using a flow cytometer (Cell Lab Quanta SC, Beckman). The spermatozoa that were not stained with PI were judged to be viable spermatozoa, and spermatozoa that were not stained with PNA-FITC were judged to be normal acrosome-spermatozoa. The result of the determination is shown in FIG. 2. The highest percentage of spermatozoa that was viable and had normal acrosome was shown in the straw for artificial insemination having the TCGN diluent as a dilution layer. The percentage of spermatozoa that were viable and had normal acrosome was also shown to be high in the straw for artificial insemination having physiological saline as a dilution layer.

Example 4

Effect of the Ratio of the TCGN Dilution Layer to the Semen Preserving Layer in a Straw for Artificial Insemination Comprising the TCGN Dilution Layer, the Partitioning Layer, and the Semen Preserving Layer in the Cavity of the Straw on the Motility of Spermatozoa after Freezing and Thawing Straws for artificial insemination comprising a TCGN dilution layer and a semen preserving layer at a ratio described in the table below, and 10 mm of an air partitioning layer as the partitioning layer in cotton plug-inserted plastic straws were prepared.
[Table 1]

TABLE 1

| The ratio of the semen preserving layer to the TCGN dilution layer | | | | | | |
|---|---|---|---|---|---|---|
| Ratio | | Liquid volume (μl) | | Length (mm) | | |
| Semen preserving layer | TCGN layer | Semen preserving layer | TCGN layer | Semen preserving layer | Air layer | TCGN layer |
| 0.5 | 9.5 | 20 | 380 | 4.0 | 10.0 | 76.0 |
| 1 | 9 | 40 | 360 | 8.0 | 10.0 | 72.0 |
| 2 | 8 | 80 | 320 | 16.0 | 10.0 | 64.0 |
| 3 | 7 | 120 | 280 | 24.0 | 10.0 | 56.0 |
| 4 | 6 | 160 | 240 | 32.0 | 10.0 | 48.0 |
| 5 | 5 | 200 | 200 | 40.0 | 10.0 | 40.0 |
| 6 | 4 | 240 | 160 | 48.0 | 10.0 | 32.0 |
| 7 | 3 | 280 | 120 | 56.0 | 10.0 | 24.0 |
| 8 | 2 | 320 | 80 | 64.0 | 10.0 | 16.0 |
| 9 | 1 | 360 | 40 | 72.0 | 10.0 | 8.0 |

Figure 3:
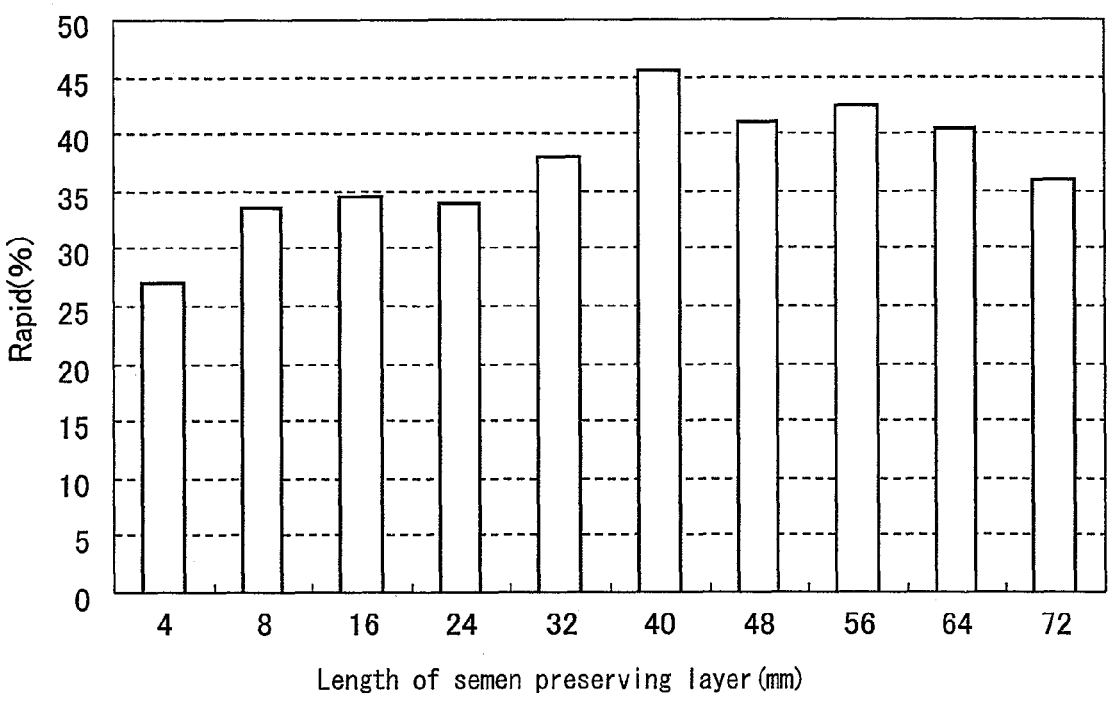
FIG. 3 is a graph showing spermatozoa motility after freeze-preserved and thawed straws for artificial insemination wherein the ratios of the TCGN dilution layer and the semen preserving layer in the cavity of the straw were varied. By assuming the length of the TCGN dilution layer+the length of the semen preserving layer =80 mm, the length of the semen preserving layer was varied at 4-72 mm and the motility of the spermatozoa after thawing was examined. It can be seen that at the ratio of the TCGN dilution layer: the semen preserving layer=2:3 to 4:1, spermatozoa motility is excellent, with the most excellent motility being obtained when the ratio is 1:1.

These straws for artificial insemination were freeze preserved in liquid nitrogen according to a conventional method. After thawing, a part of the semen preserving layer among the contents of these straws for artificial insemination was transferred to conical tubes, and spermatozoa motility was tested by using CASA at 38° C. The motility is expressed in terms of the percentage (Rapid(%)) of spermatozoa that swam 50 μm or more in a second. The result of the experiment is shown in FIG. 3. It was shown that when the length of the semen preserving layer was 32, 40, 48, 56, and 64 mm, i.e., the ratio of the TCGN dilution layer to the semen preserving layer was in the range of 3:2 to 1:4, spermatozoa motility after thawing was high. Furthermore, when the ratio of the TCGN dilution layer to the semen preserving layer was 1:1, spermatozoa motility after thawing was the highest.

Example 5

Conception Experiment Using a Straw for Artificial Insemination Comprising a TCGN Dilution Layer, a Partitioning Layer, and a Semen Preserving Layer in the Cavity of the Straw Straws for artificial insemination comprising a TCGN dilution layer, an air partitioning layer, and a semen preserving layer in the cavity thereof and, as the control, straws for artificial insemination comprising a glycerol-added egg yolk-tris-saccharide solution dilution layer, a partitioning layer, and a semen preserving layer in the cavity thereof were thawed at 38° C. according to a conventional method, loaded in a plastic injector, and injected into the internal uterine orifice or the uterine lumen of female cattle in the last phase of estrus. After injection, the conception status was examined by the non-return method or the fetal membrane slip technique (60 days), and then the conception rate was determined.

Figure 4:
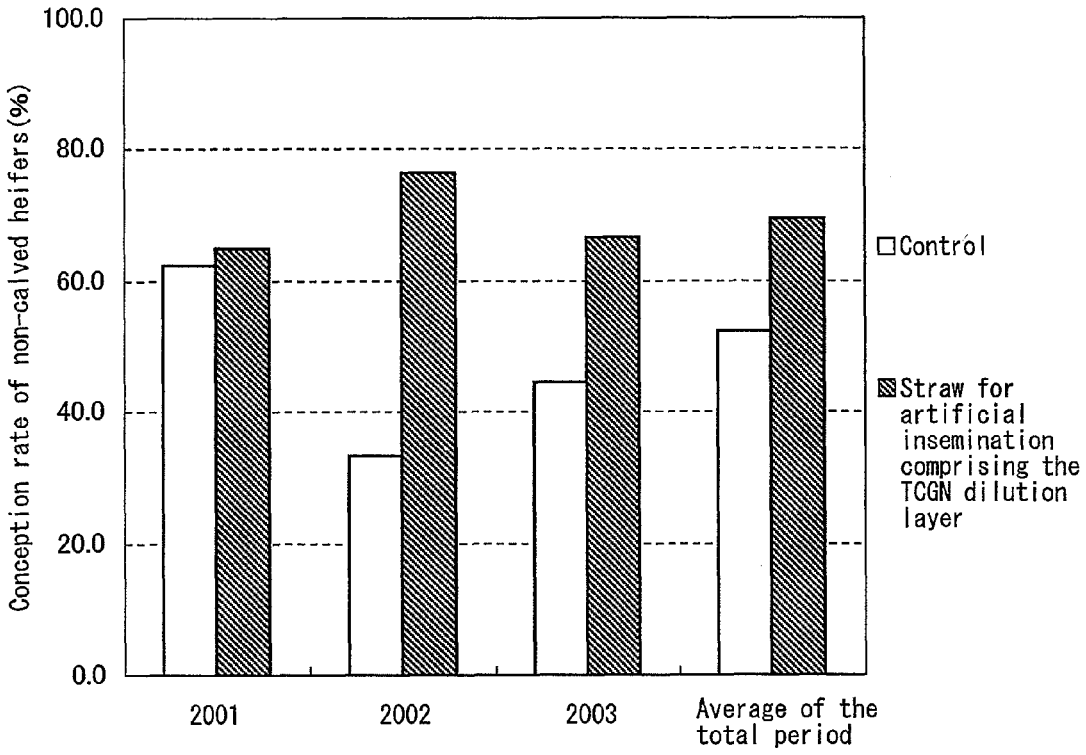
FIG. 4 is a graph showing the result of conception experiments on non-calved heifers. When multilayer straws comprising a TCGN dilution layer, a partitioning layer, and a semen preserving layer in the cavity of the straw were used, the conception rate was shown to be enhanced compared to the control. The control shows the conception rate when a multilayer straw comprising a dilution layer, a partitioning layer, and a semen preserving layer was used, wherein said dilution layer consists of an aqueous solution (glycerol-added egg yolk-tris-saccharide solution) having the same ingredients as in the semen preserving layer but having no semen.
Figure 5:
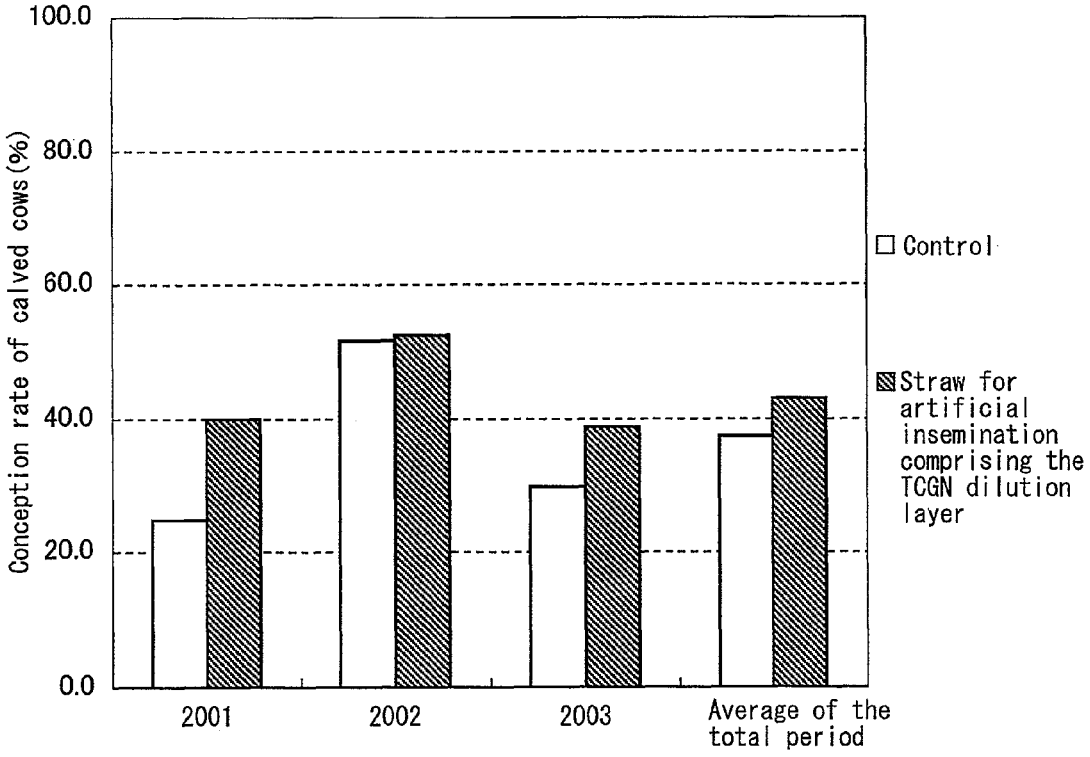
FIG. 5 is a graph showing the result of conception experiments on calved cows. When straws for artificial insemination comprising a TCGN dilution layer, a partitioning layer, and a semen preserving layer in the cavity of the straw were used, the conception rate was shown to be enhanced compared to the control. The control shows the conception rate when a straw for artificial insemination comprising a dilution layer, a partitioning layer, and a semen preserving layer was used, wherein the dilution layer consists of an aqueous solution (glycerol-added egg yolk-tris-saccharide solution) having the same ingredients as in the semen preserving layer but having no semen.

Since, cows that experienced calving generally have low conception rates, two groups of the non-calved heifers and the calved cows were examined. The result of the experiment is as described below, and this result is also shown in FIG. 4 and FIG. 5.

TABLE 2

| Year | History of calving | Section | No. of inseminated animals | No. of conceived animals | Conception rate (%) |
|---|---|---|---|---|---|
| 2001 | Non-calved | Control | 24 | 15 | 62.5% |
| | | Test | 20 | 13 | 65.0% |
| | Calved | Control | 16 | 4 | 25.0% |
| | | Test | 20 | 8 | 40.0% |
| 2002 | Non-calved | Control | 9 | 3 | 33.3% |
| | | Test | 17 | 13 | 76.5% |
| | Calved | Control | 29 | 15 | 51.7% |
| | | Test | 21 | 11 | 52.4% |
| 2003 | Non-calved | Control | 9 | 4 | 44.4% |
| | | Test | 9 | 6 | 66.7% |
| | Calved | Control | 30 | 9 | 30.0% |
| | | Test | 31 | 12 | 38.7% |
| Total | Non-calved | Control | 42 | 22 | 52.4% |
| | | Test | 46 | 32 | 69.6% |
| | Calved | Control | 75 | 28 | 37.3% |
| | | Test | 72 | 31 | 43.1% |

Figure 6:
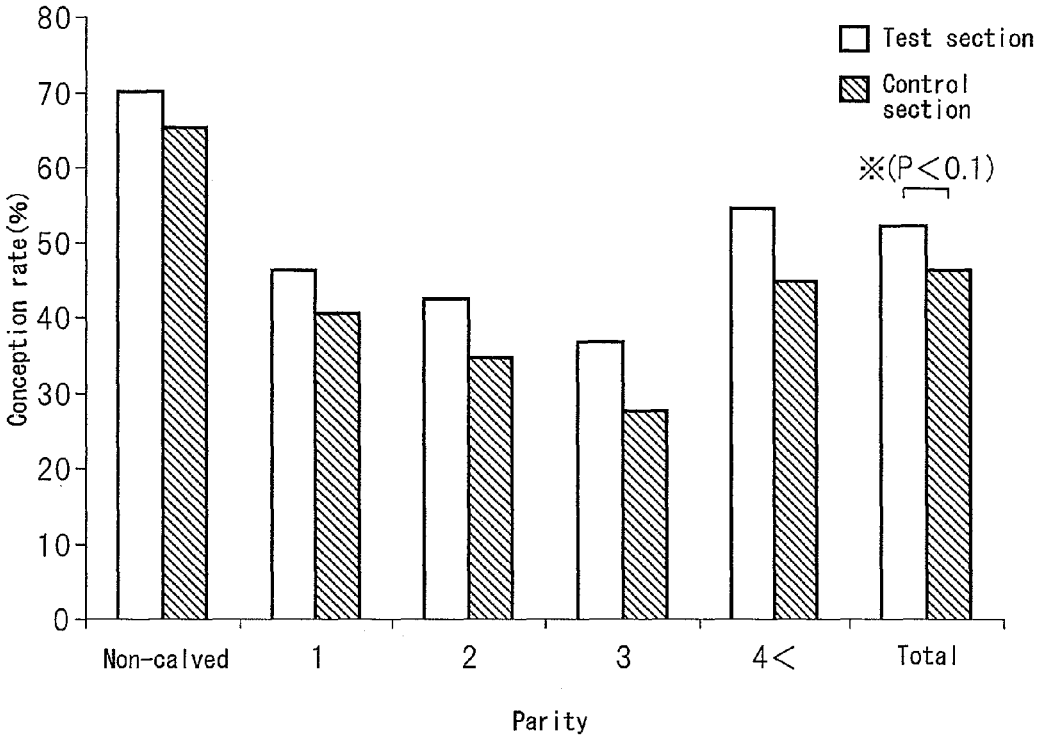
FIG. 6 is a graph showing separately the result of conception experiments on non-calved heifers and conception experiments on calved cows for each parity. When straws for artificial insemination comprising a TCGN dilution layer, a partitioning layer, and a semen preserving layer in the cavity of the straw were used, the conception rate was shown to be enhanced compared to the control. The control shows the conception rate when a straw for artificial insemination comprising a dilution layer, a partitioning layer, and a semen preserving layer was used, wherein the dilution layer consists of an aqueous solution (glycerol-added egg yolk-tris-saccharide solution) having the same ingredients as in the semen preserving layer but having no semen.

The results of the conception experiments from 2001 to 2010 (the test section: 382 cattle, the control section: 387 cattle) are shown separately for non-calved heifers and calved cows of each parity in FIG. 6. In FIG. 6, the conception rate was shown to be increased in the test section for the non-calved heifers and all of the calved cows of each parity. When the results for non-calved heifers and the results for the calved cows of each parity were summed up, a significant enhancement of the conception rate was shown in the test section as compared to the control section (chi-square test: $P<0.1$).

Example 6

Figure 7:
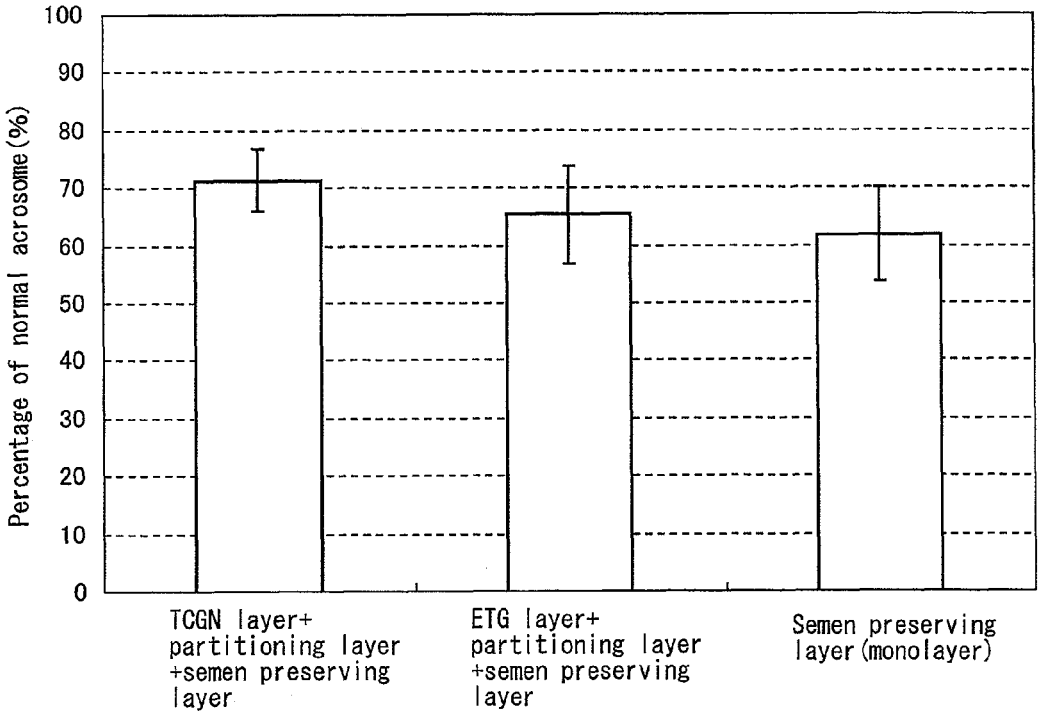
FIG. 7 is a graph showing the percentage of normal acrosome in the semen within straws for artificial insemination that were freeze-preserved and thawed. The experiments were performed on straws for artificial insemination, comprising a glycerol-added egg yolk-tris-saccharide (ETG) layer+a partitioning layer+a semen preserving layer, a TCGN dilution layer+a partitioning layer+a semen preserving layer, or a semen preserving layer (monolayer, 450 μl) in the cavity of the straw. The values are expressed in mean and standard deviation (N=4). The ratio of normal acrosome is shown to be the highest, when a straw for artificial insemination comprising a TCGN dilution layer+a partitioning layer+a semen preserving layer in the cavity of the straw is used.

Determination of the Rate of Spermatozoa Having Normal Acrosome after Freezing and Thawing of Straws for Artificial Insemination (1) Straws for artificial insemination comprising a glycerol-added egg yolk-tris-saccharide solution dilution layer, an air partitioning layer, and a semen preserving layer (an ETG layer+a partitioning layer+a semen preserving layer) in the cavity thereof, (2) straws for artificial insemination comprising a TCGN dilution layer, an air partitioning layer, and a semen preserving layer (a TCGN layer+a partitioning layer+a semen preserving layer) in the cavity thereof, and (3) straws for artificial insemination comprising a monolayer semen preserving layer (450 μl) in the cavity thereof, all of the straws being stored in liquid nitrogen, were thawed at 38° C. according to a conventional method. The entire contents of the straw were transferred to polystyrene conical tubes, which were then well agitated. Then, 5-10 μl of semen was placed and smeared on a slide glass, air-dried for 2-3 hours, and Giemsa-stained. The morphology was examined for 300-500 spermatozoa to determine the rate of normal acrosome. The result of determination is shown in FIG. 7.

Example 7

Figure 8:
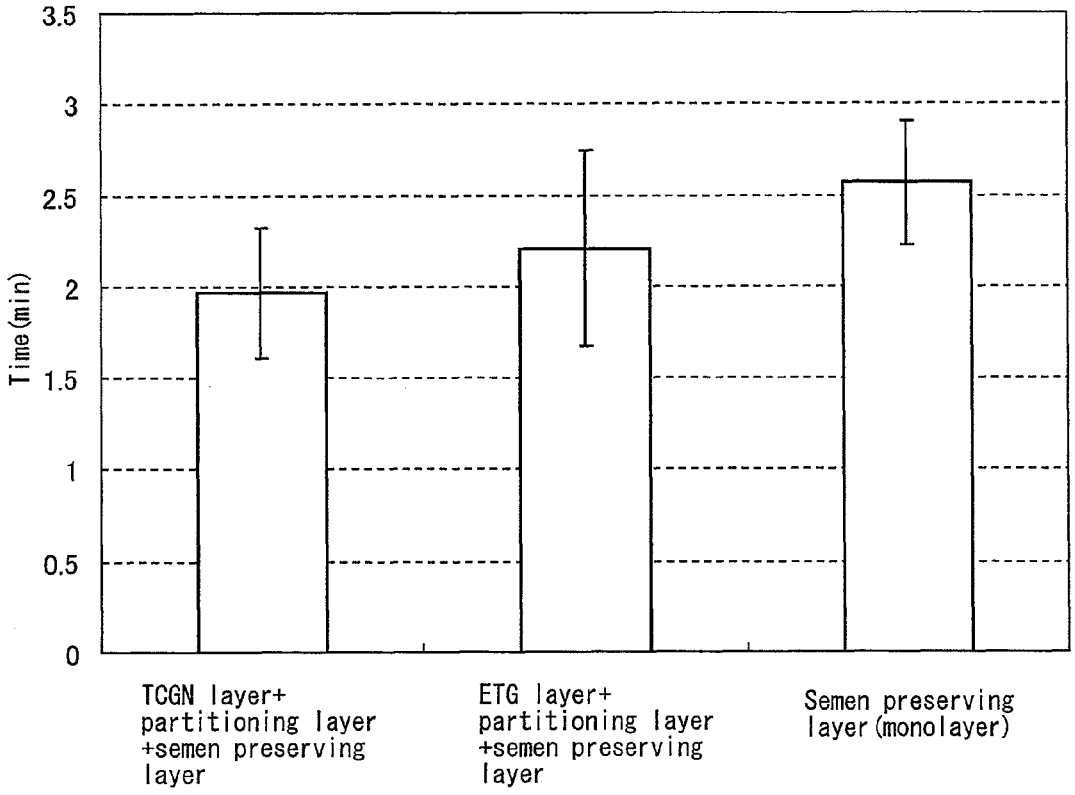
FIG. 8 is a graph showing the supercooling time of the semen preserving layer at the time of freezing straws for artificial insemination in liquid nitrogen vapor, said straws comprising glycerol-added egg yolk-tris-saccharide (ETG)

Determination of Effect of Supercooling During the Freezing of Straws for Artificial Insemination (1) Straws for artificial insemination comprising a glycerol-added egg yolk-tris-saccharide solution dilution layer, an air partitioning layer, and a semen preserving layer (an ETG layer+a partitioning layer+a semen preserving layer) in the cavity thereof, (2) straws for artificial insemination comprising a TCGN dilution layer, an air partitioning layer, and a semen preserving layer (a TCGN layer+a partitioning layer+a semen preserving layer) in the cavity thereof, and (3) straws for artificial insemination comprising a monolayer semen preserving layer (450 μl) in the cavity thereof were frozen by exposing them to a liquid nitrogen vapor according to a conventional method. At this time, a temperature sensor was inserted into the semen preserving layer to measure the time of supercooling in the semen preserving layer and the solidification-starting temperature. The results are shown in FIG. 8 and FIG. 9, respectively. In the straws comprising a monolayer semen preserving layer, the time of supercooling was the longest (FIG. 8), and the solidification-starting temperature was the lowest (FIG. 9). By introducing a partitioning layer to separate the semen preserving layer and the dilution layer, the supercooling time was shortened and the solidification-starting temperature rised, and furthermore by removing glycerol from the diluent, the supercooling time was shortened and the solidification-starting temperature rised. This experiment has shown that by changing from straws comprising a semen monolayer to multilayer straws comprising a dilution layer, a partitioning layer, and a semen preserving layer, and by removing glycerol from the diluent, damage to spermatozoa by supercooling can be minimized. As a result of reduced supercooling, it is believed that the normal acrosome rate of Example 6 was improved. Prevention of supercooling is thought to be due to the ice formation effect since the glycerol-free dilution layer freezes first. It is believed that although there is an air partitioning layer between the dilution layer and the semen preserving layer, since the diluent passes through the straw first, a trace amount of the diluent that was attached to the cavity of the straw freezes, thereby promoting the freezing of the semen preserving layer.

We claim:

1. A straw for artificial insemination of cattle, comprising:

a straw;

a dilution layer comprising an aqueous solution comprising sodium chloride, wherein glycerol is not added to the dilution layer;

a partitioning layer, and a semen preserving layer comprising an aqueous solution containing cattle semen and a cryoprotectant, wherein the layers are disposed in a cavity of said straw, the dilution layer and the semen preserving layer are separated by the partitioning layer, and a volume ratio of the dilution layer to the semen preserving layer is 3:2 to 1:4, and wherein the dilution layer and semen preserving layer are frozen.

2. The straw for artificial insemination according to claim 1, wherein said dilution layer does not contain glycerol.

3. The straw for artificial insemination according to claim 1, wherein an osmotic pressure of the aqueous solution of said dilution layer is 230 to 400 mOsm and pH thereof is 6.4 to 7.5.

4. The straw for artificial insemination according to claim 1, wherein a liquid volume of said straw for artificial insemination is 0.25 to 0.5 ml.

5. The straw for artificial insemination according to claim 1, wherein the aqueous solution in the dilution layer further comprises a buffer.

6. The straw for artificial insemination according to claim 5, wherein the buffer comprises tris(hydroxymethylaminomethane) and citric acid.

7. The straw for artificial insemination according to claim 1, wherein the aqueous solution in the dilution layer further comprises a saccharide.

8. The straw for artificial insemination according to claim 7, wherein the saccharide comprises glucose.

9. The straw for artificial insemination according to claim 1, wherein a concentration of sodium chloride is 50-200 mM.

* * * * *